US008376361B2

(12) United States Patent
Brewer, III

(10) Patent No.: US 8,376,361 B2
(45) Date of Patent: Feb. 19, 2013

(54) METHOD AND APPARATUS FOR PRINTED MEDIA STACK MANAGEMENT IN AN IMAGE PRODUCTION DEVICE

(75) Inventor: Charles Raymond Brewer, III, Farmington, NY (US)

(73) Assignee: Xerox Corporation, Norwalk, CT (US)

( * ) Notice: Subject to any disclaimer, the term of this patent is extended or adjusted under 35 U.S.C. 154(b) by 338 days.

(21) Appl. No.: 12/486,428

(22) Filed: Jun. 17, 2009

(65) Prior Publication Data

US 2010/0320680 A1 Dec. 23, 2010

(51) Int. Cl.
*B65H 39/10* (2006.01)

(52) U.S. Cl. ..... 271/303; 271/176

(58) Field of Classification Search ..... 271/176, 271/184, 298, 303, 207, 213
See application file for complete search history.

(56) References Cited

U.S. PATENT DOCUMENTS 3,951,264 A * 4/1976 Heidecker et al. ..... 206/308.3
4,945,390 A * 7/1990 Hasegawa et al. ..... 399/405
5,553,528 A * 9/1996 Zoltner ..... 83/443
5,666,630 A * 9/1997 Zoltner et al. ..... 399/405
6,234,474 B1 * 5/2001 Horii et al. ..... 271/288
7,500,662 B2 3/2009 Graushar
7,784,788 B2 * 8/2010 Fukatsu et al. ..... 271/292
8,047,543 B2 * 11/2011 Toriyabe et al. ..... 271/298
2008/0042342 A1 * 2/2008 Tominaga et al. ..... 271/298
2008/0099983 A1 * 5/2008 Hayashi ..... 271/207
2008/0157466 A1 * 7/2008 Fukatsu et al. ..... 271/303
2009/0146368 A1 * 6/2009 Kurohata ..... 271/207
2009/0224468 A1 * 9/2009 Fukatsu et al. ..... 271/279
2009/0309300 A1 * 12/2009 Obuchi et al. ..... 271/288
2010/0044957 A1 * 2/2010 Yang ..... 271/225
2010/0078878 A1 * 4/2010 Nakamura et al. ..... 271/220

* cited by examiner

*Primary Examiner* — Prasad Gokhale
(74) *Attorney, Agent, or Firm* — Ronald E. Prass, Jr.; Prass LLP

(57) ABSTRACT

A method and apparatus for printed media stack management in an image production device is disclosed. The method may include determining if a media stacker device has been removed from a finishing module during a print job, wherein if it is determined that the media stacker device has been removed from the finishing module during a print job, moving one or more media path selection devices to enable the printed media to be stacked onto a media stacking tray, determining if the media stacker device has been returned to the finishing module, wherein if it is determined that the media stacker device has been returned to the finishing module, moving the one or more media path selection devices to enable the printed media to be stacked onto the media stacker device.

15 Claims, 4 Drawing Sheets

METHOD AND APPARATUS FOR PRINTED MEDIA STACK MANAGEMENT IN AN IMAGE PRODUCTION DEVICE

BACKGROUND

Disclosed herein is a method and apparatus for printed media stack management in an image production device.

Large format/production image production devices are generally large machines with a big footprint that require a great deal of physical space. Many image production devices include two finishing modules. Therefore, if one media stacking device (such as a stacking cart) becomes full of printed media sheets, the image production device begins stacking the media sheets on the other media stacking device located in the second finishing module.

However, if a large image production device is needed but only a small footprint is desired, the image production device may only be equipped with a single finishing module. This configuration creates a problem on long print job runs because there is currently no capability to allow continuous running while emptying the stacking cart. The print job must be paused while the media stacking device is removed, unloaded, and returned, or another media stacking device is positioned in its place. This problem slows down the processing time and manual labor involved in long print job runs.

SUMMARY

A method and apparatus for printed media stack management in an image production device is disclosed. The method may include determining if a media stacker device has been removed from a finishing module during a print job, wherein if it is determined that the media stacker device has been removed from the finishing module during a print job, moving one or more media path selection devices to enable the printed media to be stacked onto a media stacking tray, determining if the media stacker device has been returned to the finishing module, wherein if it is determined that the media stacker device has been returned to the finishing module, moving the one or more media path selection devices to enable the printed media to be stacked onto the media stacker device.

DETAILED DESCRIPTION

Figure 1:
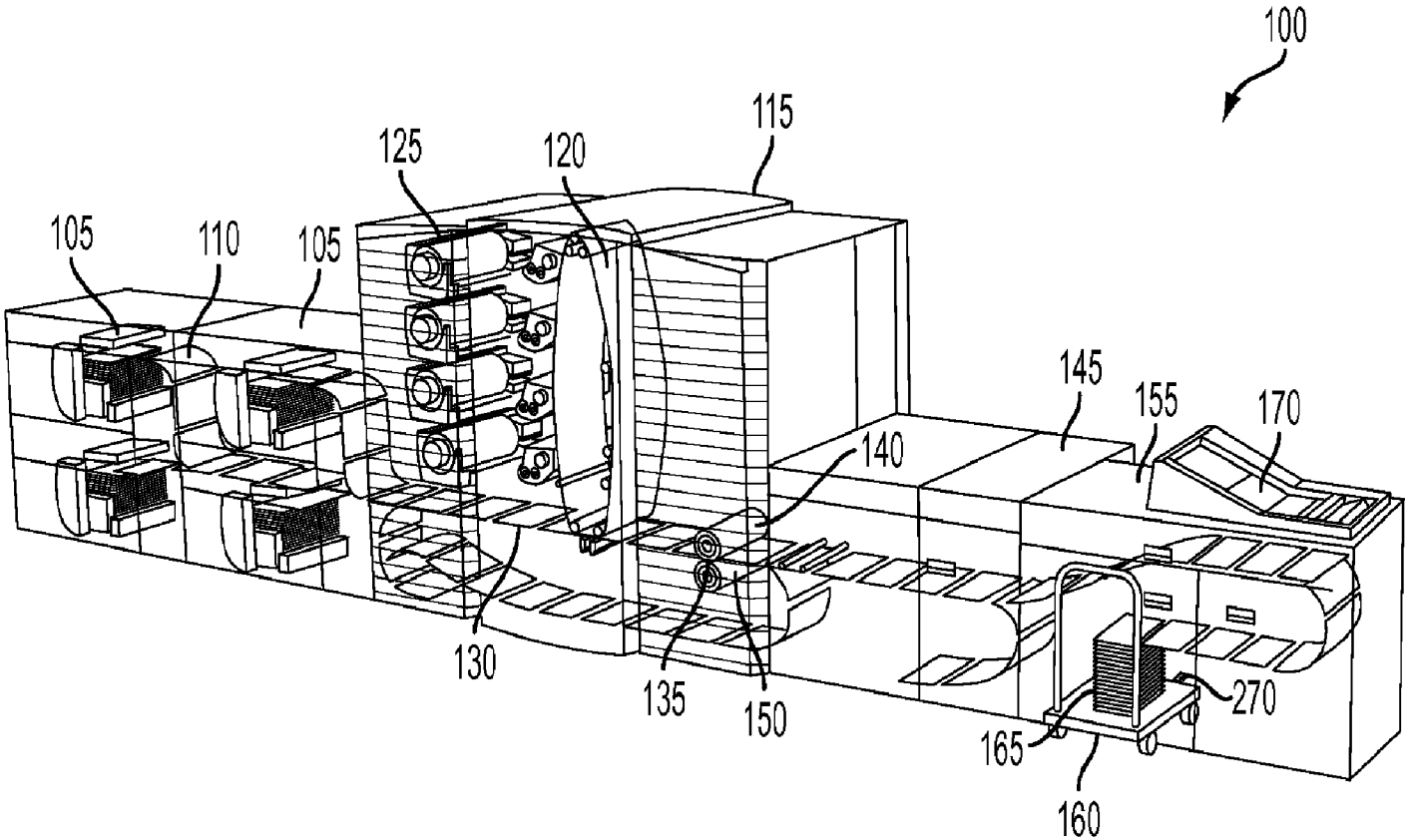
FIG. 1 is an exemplary diagram of an image production device in accordance with one possible embodiment of the disclosure.

Aspects of the embodiments disclosed herein relate to a method and apparatus for printed media stack management in an image production device.

The disclosed embodiments may include a method and apparatus for printed media stack management in an image production device. The method may include determining if a media stacker device has been removed from a finishing module during a print job, wherein if it is determined that the media stacker device has been removed from the finishing module during a print job, moving one or more media path selection devices to enable the printed media to be stacked onto a media stacking tray, determining if the media stacker device has been returned to the finishing module, wherein if it is determined that the media stacker device has been returned to the finishing module, moving the one or more media path selection devices to enable the printed media to be stacked onto the media stacker device.

The disclosed embodiments may further include an image production device that may include a finishing module that receives printed media sheets after images have been applied and processes them for output to a user, a media stacker device sensor that senses the presence of a media stacker device in the finishing module, a media stacker device located in the finishing module that receives media sheets that form a first media stack and is removable from the finishing module, and a media stacking tray that receives media sheets that form a second media stack, one or more media path selection devices that when moved determine whether media stacks form on the media stacker device or the media stacking tray, and a media stacking management unit that determines if the media stacker device has been removed from the finishing module during a print job, wherein if the media stacking management unit determines that the media stacker device has been removed from the finishing module during a print job, the media stacking management unit moves the one or more media path selection devices to enable the printed media to be stacked onto a media stacking tray and determines if the media stacker device has been returned to the finishing module, wherein if the media stacking management unit determines that the media stacker device has been returned to the finishing module, the media stacking management unit moves the one or more media path selection devices to enable the printed media to be stacked onto the media stacker device.

The disclosed embodiments may further include computer-readable medium storing instructions for controlling a computing device for printed media stack management in an image production device. The instructions may include determining if a media stacker device has been removed from a finishing module during a print job, wherein if it is determined that the media stacker device has been removed from the finishing module during a print job, moving one or more media path selection devices to enable the printed media to be stacked onto a media stacking tray, determining if the media stacker device has been returned to the finishing module, wherein if it is determined that the media stacker device has been returned to the finishing module, moving the one or more media path selection devices to enable the printed media to be stacked onto the media stacker device.

The disclosed embodiments may concern using the function of the top media stacking tray in an image production device for short durations on long print job runs to allow the media stacker device (such as a media stacker cart) to be removed and an empty cart to be placed back in the finishing module. By allowing the destination to be a media stacking tray (e.g., the top media stacking tray) for a short time, the full media stacker cart can be removed, an empty cart placed back in the finishing module, the media stacking on the media stacking tray cease, and the media stacking resume on the media stacker cart. The media sheets stacked on the media stacking tray may then simply be removed from the tray and placed on the full media stacker cart to retain print job integrity.

Thus, the disclosed embodiments concern utilizing a media stacking tray (such as the top media stacking tray) as an output destination buffer while the loaded media stacker cart is removed and replaced with an empty cart. In this manner, one or more media path selection devices, such a diverter gate, may be controlled to allow diversion to the top media stacking tray, for example. This buffering may allow the media stacker cart to lower, be replaced with an empty media stacker cart which may then be raised back into position before the diverter gate switches the destination back to the media stacker cart.

The media (such as paper) stacked in the printed media stacking tray during the buffer cycle can now simply be placed on top of the media stack on the full media stacker cart that was previously removed, in order to maintain print job integrity.

Thus, this system may allow a single finishing module to be run on an image production device for large jobs. This feature may gain productivity specifically with long jobs, such as 10,000 sheet runs, for example. By using an image production device that incorporates the disclosed embodiments, customers with limited space for device footprints could gain higher productivity using a single finishing module without resorting to a two finishing module and the ensuing larger device footprint.

FIG. 1 is an exemplary diagram of an image production device 100 in accordance with one possible embodiment of the disclosure. The image production device 100 may be any device that may be capable of making image production documents (e.g., printed documents, copies, etc.) through a xerographic process, including a copier, a printer, a facsimile device, and a multi-function device (MFD), for example.

The image production device 100 may include two media feeder modules 105 arranged in series, an image production module 115 adjacent the media feeding modules 105, an inverter module 145 adjacent the image production module 115, a media transport section, 130, and two finishing modules 155 arranged in series adjacent the inverter module 145. In the image production device 100, the media feeder modules 105 feed media to the image production module 115.

In the image production module 115, toner is transferred from a series of developer stations 125 to a charged photoreceptor belt 120 to form toner images on the photoreceptor belt 120 and produce toner images. The toner images are transferred to respective media 110 fed through the paper path. The media sheets may be advanced through a fuser 135 including a fuser roll 140 and pressure roll 150, which form a nip where heat and pressure are applied to the media to fuse toner images onto the media.

The inverter module 145 may manipulate media exiting the image production module 115 by either passing the media through to the finishing modules 155, or inverting and returning the media to the image production module 115. In the finishing modules 155, the printed media sheets may be loaded onto a stacker device 160, such as a stacker tray, cart, etc. to form a printed media stack 165, or onto a media stacking tray 170 located above or adjacent to the finishing module 155, for example.

The finishing module 155 may include finishing hardware for stacking, folding, stapling, binding, etc., prints which are output from the image production module 115. The image production device 100 may also include a local user interface (not shown) for controlling its operations, although another source of image data and instructions may include any number of computers to which the printer is connected via a network.

While the term printed media stack 165 is used for ease of discussion, the media stack 165 may represent any type of media sheets used to produce documents in the image production device 100, such as any type of paper, plastic, photo paper, cardboard, etc. In addition, for ease of discussion, the term media stack 170 may represent an entire media stack or a portion of a media stack, for example.

Figure 2:
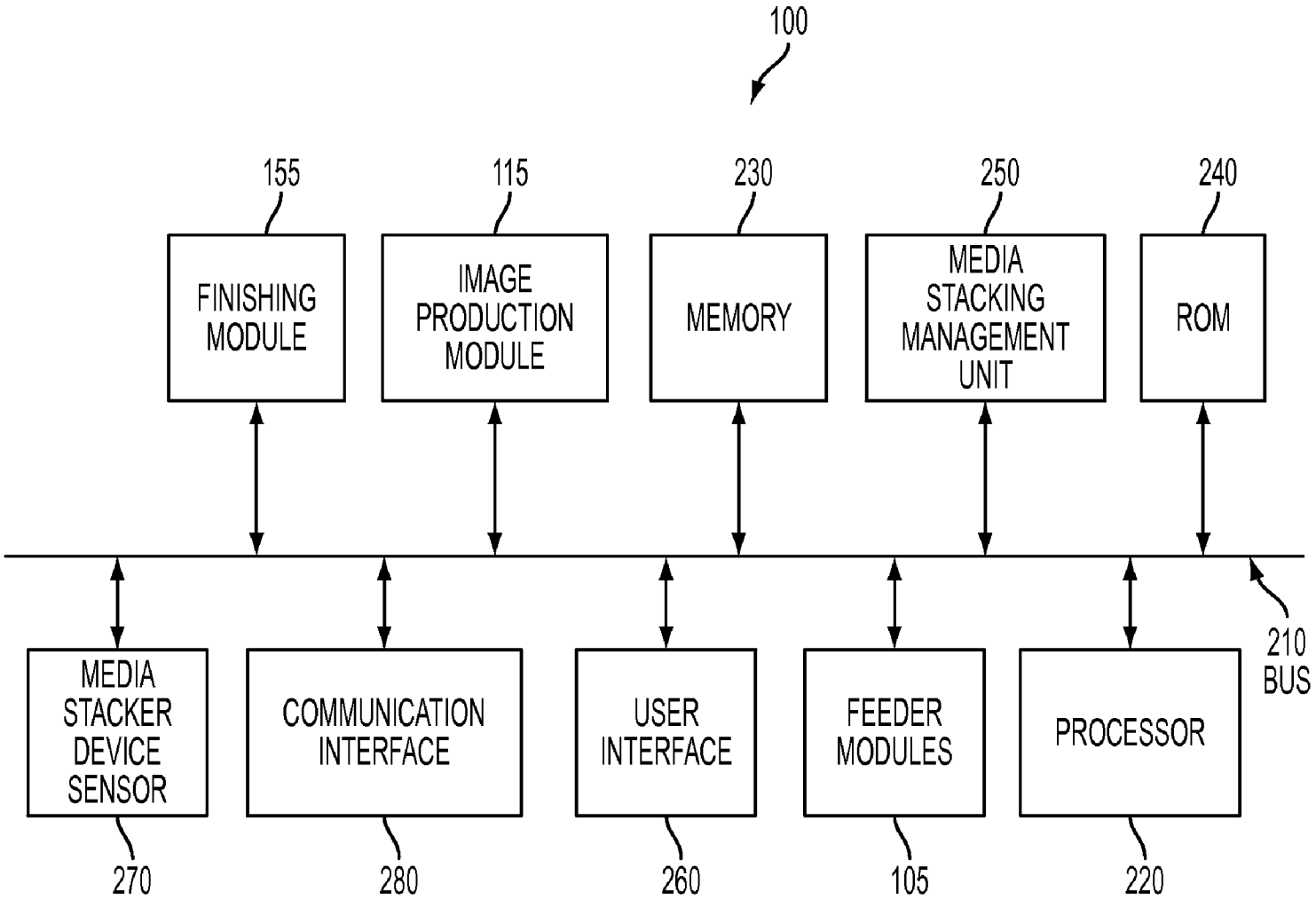
FIG. 2 is an exemplary block diagram of the image production device in accordance with one possible embodiment of the disclosure.

FIG. 2 is an exemplary block diagram of the image production device 100 in accordance with one possible embodiment of the disclosure. FIG. 2 is an exemplary block diagram of the image production device 100 in accordance with one possible embodiment of the disclosure. The image production device 100 may include a bus 210, feeder modules 105, image production section 115, finishing module 155, a processor 220, a memory 230, a read only memory (ROM) 240, a printed media stack management unit 250, a user interface 260, a media stacker cart sensor 270, and a communication interface 280. Bus 210 may permit communication among the components of the image production device 100.

Processor 220 may include at least one conventional processor or microprocessor that interprets and executes instructions. Memory 230 may be a random access memory (RAM) or another type of dynamic storage device that stores information and instructions for execution by processor 220. Memory 230 may also include a read-only memory (ROM) which may include a conventional ROM device or another type of static storage device that stores static information and instructions for processor 220.

Communication interface 280 may include any mechanism that facilitates communication via a network. For example, communication interface 280 may include a modem. Alternatively, communication interface 280 may include other mechanisms for assisting in communications with other devices and/or systems.

ROM 240 may include a conventional ROM device or another type of static storage device that stores static information and instructions for processor 220. A storage device may augment the ROM and may include any type of storage media, such as, for example, magnetic or optical recording media and its corresponding drive.

As stated above, user interface 260 may include one or more conventional mechanisms that permit a user to input information to and interact with the image production unit 100, such as a keyboard, a display, a mouse, a pen, a voice recognition device, touchpad, buttons, etc., for example. The finishing module 155 may include one or more conventional mechanisms that output image production documents to the user, including output trays, output paths, finishing section, etc., for example. The image production module 115 may include an image printing and/or copying section, a scanner, a fuser, a spreader, etc., for example. The media stacker device sensor 270 may detect the presence and/or absence of a media stacker device 160, such as a media stacker cart.

The image production device 100 may perform such functions in response to processor 220 by executing sequences of instructions contained in a computer-readable medium, such as, for example, memory 230. Such instructions may be read into memory 230 from another computer-readable medium, such as a storage device or from a separate device via communication interface 280.

The image production device 100 illustrated in FIGS. 1-2 and the related discussion are intended to provide a brief, general description of a suitable communication and processing environment in which the disclosure may be implemented. Although not required, the disclosure will be described, at least in part, in the general context of computer-executable instructions, such as program modules, being executed by the image production device 100, such as a communication server, communications switch, communications router, or general purpose computer, for example.

Generally, program modules include routine programs, objects, components, data structures, etc. that perform particular tasks or implement particular abstract data types. Moreover, those skilled in the art will appreciate that other embodiments of the disclosure may be practiced in communication network environments with many types of communication equipment and computer system configurations, including personal computers, hand-held devices, multi-processor systems, microprocessor-based or programmable consumer electronics, and the like.

The operation of the printed media stack management unit 250 will be discussed below in relation to the flowchart in FIG. 4.

Figure 3:
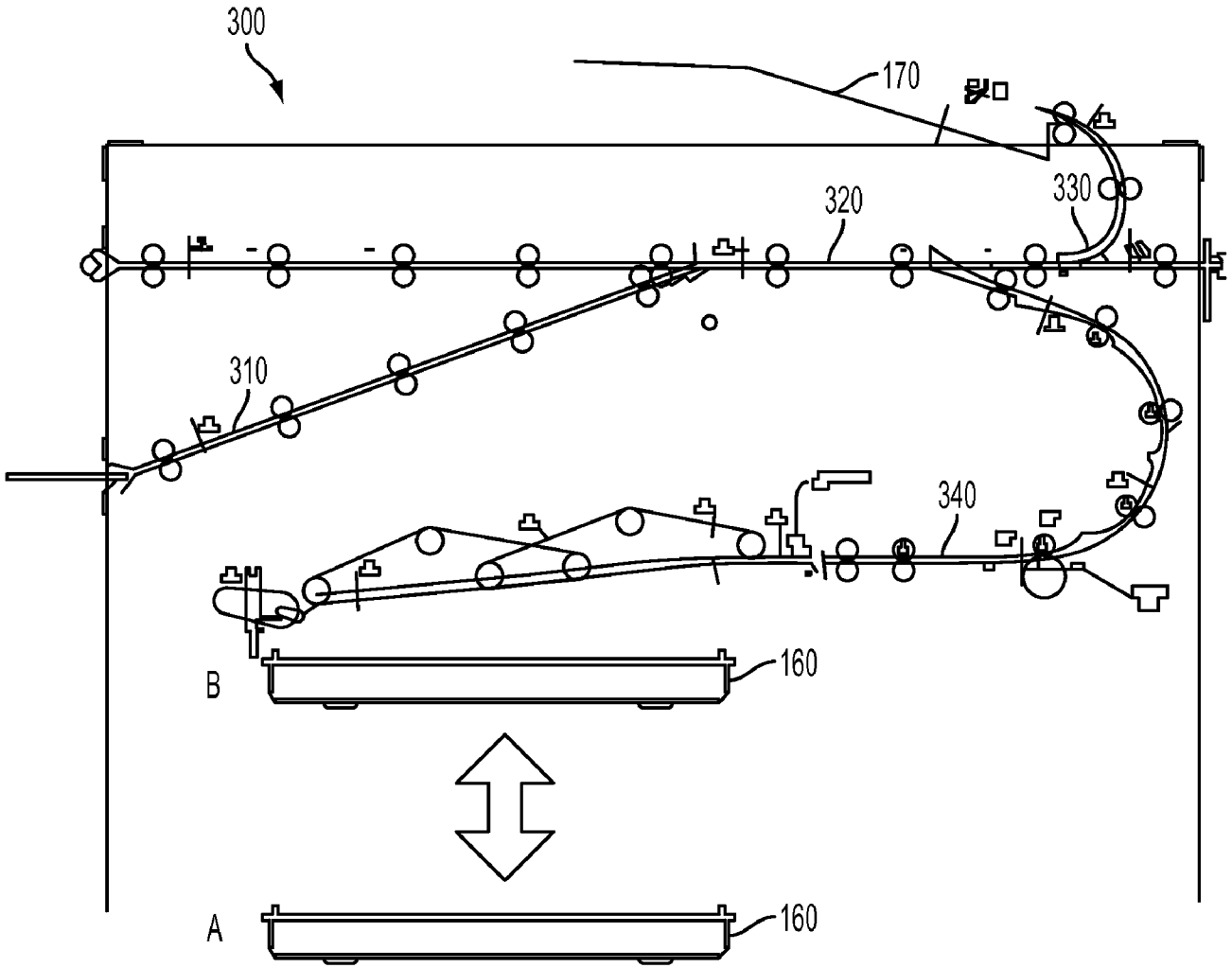
FIG. 3 is an exemplary diagram of the media stacking environment of the image production device in accordance with one possible embodiment of the disclosure.

FIG. 3 is an exemplary diagram of the media stacking environment 300 of the image production device 100 in accordance with one possible embodiment of the disclosure. The exemplary media stacking environment 300 may be found in an image production device 100 having a single exemplary finishing module 155 and may include a media stacker device 160, a media stacking tray 170, a document entrance path 310, a document transition area 320, one or more media path selection devices 330, and a document exit path 340. The media stacking tray 170 may be located on top of the finishing module 155 or may be located in another part of the image production device 100, such as on the side, front, behind, inside, etc.

The media stacker device 160 may be any cart (as shown in FIG. 1) or tray that may be made of metal (such as aluminum, steel, etc.), plastic, composite material, etc. A stacking tray may be placed on top of or be attachably-detachable to the media stacker device 160 using any attachment devices known to one of skill in the art, such as a screw, bolt, snap-in tab, snap, rivet, button, etc.

During print jobs, the media stacking environment 300 operates such that a printed media sheet may enter the document entrance path 310 and may be moved using rollers, a belt, etc. to the document transition area 320. From the document transition area 320, the position of the one or more media path selection devices 330 determines the printed media sheet's destination.

Depending on the user's preference or default selection, for example, the normal media sheet path may be to either the media stacker device 160 presumably for larger print jobs) or the media stacking tray 170 presumably for smaller print jobs). If the user or default selection is for the media stacker device 160, the position of the one or more media path selection devices 330 may be set in a manner that may allow the printed media sheets to continue to the document exit path 340 and onto the media stacker device 160. The media stacker device 160 may be moved (or have a tray that may be moved) up and down depending on the amount of printed media sheet stacked on the media stacker device 160 at any one time.

If the media stacker device 160 is removed from the finishing module 155, the media stacker device sensor 270 may sense that the media stacker device 160 has been removed and the one or more media path selection devices 330 may be signaled to move to allow the printed media sheets to be stacked onto the media stacking tray 170. The one or more media path selection devices 330 may be any devices capable of directing the flow of printed media sheets to one path or another, such a gate, lever, slide, switch, track, etc. The media stacker device 160 may be unloaded or another media stacker device 160 may be inserted into the finishing module 155 while media sheets are being stacked onto the media stacking tray 170.

The media stacker device sensor 270 may then sense that the media stacker device 160 has been returned to the finishing module 155 and may send a signal which may allow the one or more media path selection devices 330 to be positioned so that the printed media sheets are directed to the exit document path 340 and onto the media stacker cart 160. The printed media sheets stacked onto the media stacking tray 170 may be move onto the top of the media stack on the media stacker device 160 that was previously removed from the finishing module 155 to maintain print job integrity. This process enables continuous and virtually uninterrupted printing of large and time-consuming print jobs.

Note that if the media stacker device 160 is not returned to the finishing module within a predetermined sheet count, predetermined time, or upon sensing that the media stacking tray 170 is full, the print job may be suspended to avoid overfilling the media stacking tray 170.

Figure 4:
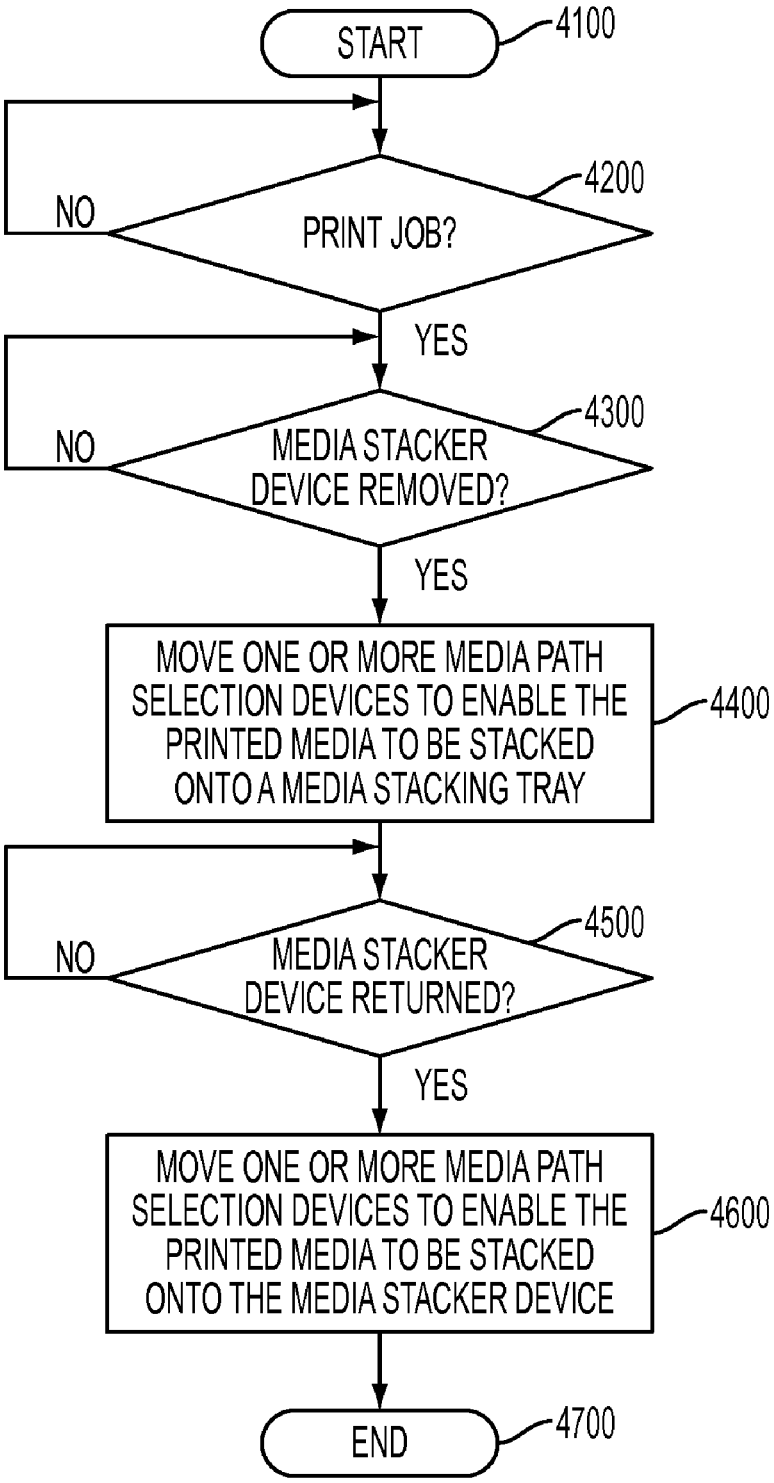
FIG. 4 is exemplary flowchart of the media stacking management process in accordance with one possible embodiment of the disclosure.

FIG. 4 is exemplary flowchart of the media stacking management process in accordance with one possible embodiment of the disclosure. The process may begin at step 4100 and may continue to step 4200 where the media stacking management unit 250 may determine if a print job is being processed. If the media stacking management unit 250 determines that a print job is not being processed, the process may return to step 4200.

If the media stacking management unit 250 determines that a print job is being processed, at step 4300, the media stacking management unit 250 may determine if the media stacker device 160 has been removed from the finishing module 155 during a print job. If the media stacking management unit 250 determines that the media stacker device 160 has not been removed from the finishing module 155 during a print job, the process may return to step 4300.

If at step 4300, the media stacking management unit 250 determines that the media stacker device 160 has been removed from the finishing module 155 during a print job, at step 4400, the media stacking management unit 250 may move the one or more media path selection devices 330 to enable the printed media to be stacked onto a media stacking tray 170. At step 4500, the media stacking management unit 250 may determine if the media stacker device 160 has been returned to the finishing module 155. If the media stacking management unit 250 determines that the media stacker device 160 has not been returned to the finishing module 155, the process may return to step 4500.

If at step 4500, the media stacking management unit 250 determines that the media stacker device 160 has been returned to the finishing module 155, at step 4600 the media stacking management unit 250 may move the one or more media path selection devices 330 to enable the printed media to be stacked onto the media stacker device 160. The process may then go to step 4700 and end.

Embodiments as disclosed herein may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hard-wired, wireless, or combination thereof to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, objects, components, and data structures, and the like that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described therein.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method for printed media stack management in an image production device, comprising:

determining if a single media stacker cart has been physically removed from a finishing module during a print job, wherein if it is determined that the single media stacker cart has been physically removed from the finishing module during a print job, moving one or more media path selection devices to enable the printed media to be stacked onto a media stacking tray, wherein the media stacking tray is located directly above the single media stacker cart and is not located on another media stacker cart;

determining if the single media stacker cart has been physically returned to the finishing module, wherein if it is determined that the single media stacker cart has been physically returned to the finishing module, and moving the one or more media path selection devices by a media stacking management unit to enable the printed media to be stacked onto the single media stacker cart.

2. The method of claim 1, wherein the one or more media path selection devices include gates that move to change the direction of documents to a particular path.

3. The method of claim 1, wherein the image production device has only one finishing module.

4. The method of claim 1, wherein the print job is suspended after the media stacking tray is full and the single media stacker cart has not been returned to the finishing module.

5. The method of claim 1, wherein the image production device is one of a copier, a printer, a facsimile device, and a multi-function device.

6. An image production device, comprising:

a finishing module that receives printed media sheets after images have been applied and processes them for output to a user;

a single media stacker cart sensor that senses the presence of a single media stacker cart in the finishing module;

a single media stacker cart located in the finishing module that receives media sheets that form a first media stack and is removable from the finishing module; and a media stacking tray that receives media sheets that form a second media stack, wherein the media stacking tray is located directly above the single media stacker cart and is not located on another media stacker cart;

one or more media path selection devices that when moved determine whether media stacks form on the single media stacker cart or the media stacking tray; and a media stacking management unit that determines if the single media stacker cart has been physically removed from the finishing module during a print job, wherein if the media stacking management unit determines that the single media stacker cart has been physically removed from the finishing module during a print job, the media stacking management unit moves the one or more media path selection devices to enable the printed media to be stacked onto a media stacking tray and determines if the single media stacker cart has been physically returned to the finishing module, wherein if the media stacking management unit determines that the single media stacker cart has been physically returned to the finishing module, the media stacking management unit moves the one or more media path selection devices to enable the printed media to be stacked onto the single media stacker cart.

7. The image production device of claim 6, wherein the one or more media path selection devices include gates that move to change the direction of documents to a particular path.

8. The image production device of claim 6, wherein the image production device has only one finishing module.

9. The image production device of claim 6, wherein the print job is suspended after the media stacking tray is full and the single media stacker cart has not been returned to the finishing module.

10. The image production device of claim 6, wherein the image production device is one of a copier, a printer, a facsimile device, and a multi-function device.

11. A non-transitory computer-readable medium storing instructions for controlling a computing device for printed media stack management in an image production device, the instructions comprising:

determining if a single media stacker cart has been physically removed from a finishing module during a print job, wherein if it is determined that the single media stacker cart has been physically removed from the finishing module during a print job, moving one or more media path selection devices to enable the printed media to be stacked onto a media stacking tray, wherein the media stacking tray is located directly above the single media stacker cart and is not located on another media stacker cart;

determining if the single media stacker cart has been physically returned to the finishing module, wherein if it is determined that the single media stacker cart has been physically returned to the finishing module, and moving the one or more media path selection devices by a media stacking management unit to enable the printed media to be stacked onto the single media stacker cart.

12. The non-transitory computer-readable medium of claim 11, wherein the one or more media path selection devices include gates that move to change the direction of documents to a particular path.

13. The non-transitory computer-readable medium of claim 11, wherein the image production device has only one finishing module.

14. The non-transitory computer-readable medium of claim 11, wherein the print job is suspended after the media stacking tray is full and the single media stacker cart has not been returned to the finishing module.

15. The non-transitory computer-readable medium of claim 11, wherein the image production device is one of a copier, a printer, a facsimile device, and a multifunction device.

* * * * *